US005918379A

United States Patent [19]

Cooke

[11] Patent Number: 5,918,379

[45] Date of Patent: Jul. 6, 1999

[54] DEVICE FOR DRYING WET INTERIOR SURFACES OF HOLLOW CONTAINERS

[75] Inventor: Barbara Cooke, New York, N.Y.

[73] Assignee: La La La La Ltd., New York City, N.Y.

[21] Appl. No.: 08/943,804

[22] Filed: Oct. 3, 1997

[51] Int. Cl.[6] ..... F26B 25/00

[52] U.S. Cl. ..... 34/105; 252/194

[58] Field of Search ..... 34/80, 79, 104, 34/105, 202; 252/194

[56] References Cited

U.S. PATENT DOCUMENTS 5,078,909 1/1992 Shigeta et al. ..... 252/194
5,191,721 3/1993 Incorvia et al. ..... 34/80

FOREIGN PATENT DOCUMENTS 26157-22 12/1988 France ..... 34/104

*Primary Examiner*—Henry Bennett
*Assistant Examiner*—Pamela A. Wilson

[57] ABSTRACT

A device for drying wet interior surfaces of a hollow container having an opening for access which employs an elongated hollow flexible moisture and air permeable member closed at both ends. One member end terminates in a long relatively thin extension. A plurality of small beads are disposed moveably in the member. The beads collect and store moisture when the member is inserted through the container opening into said container and is moved into contact with the surfaces. The beads release the moisture into ambient air thereby drying the beads after the member is removed from the container by pulling on the extension and is then exposed to ambient conditions.

4 Claims, 1 Drawing Sheet

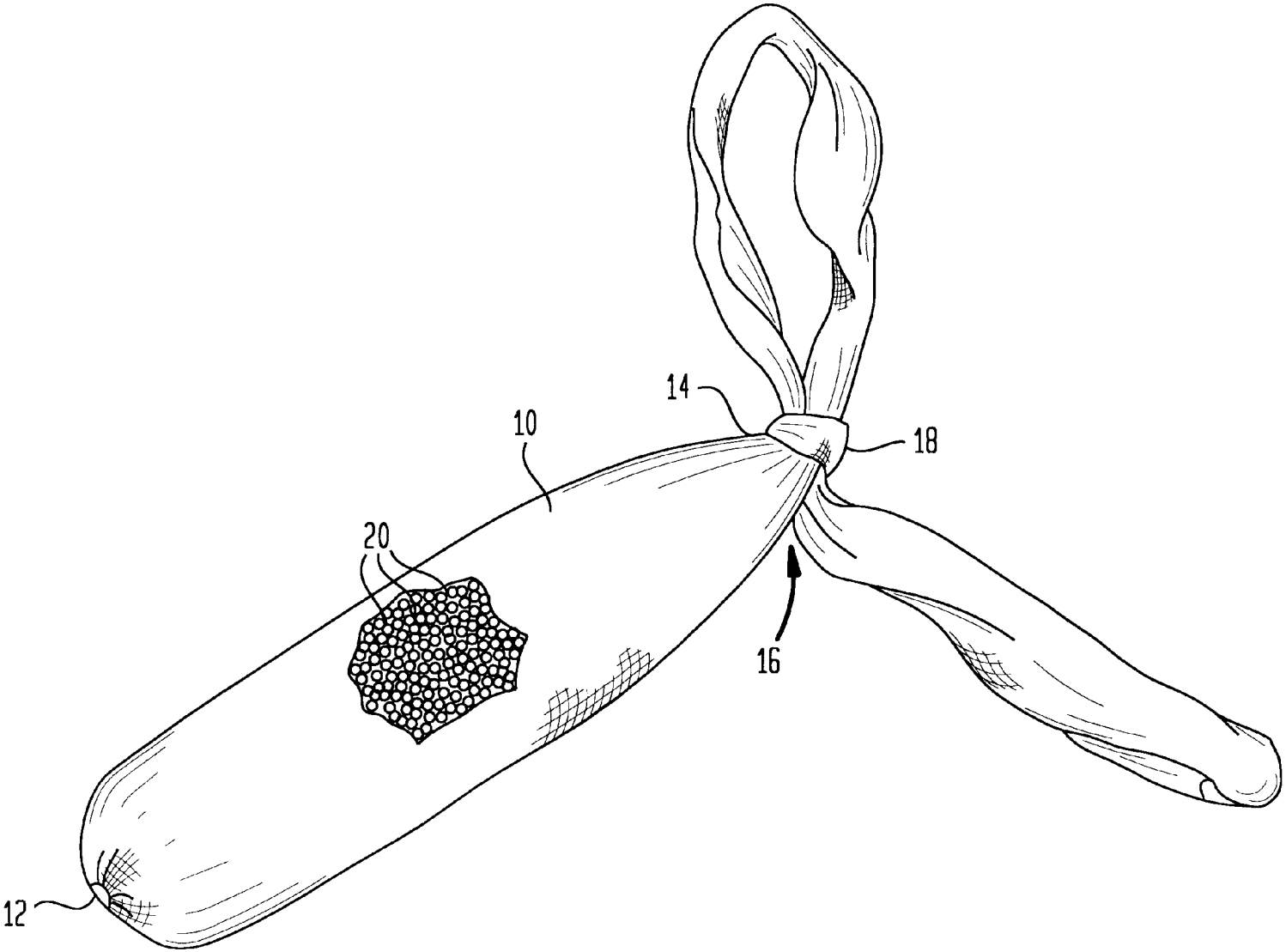
18
16
14
10
20
12

DEVICE FOR DRYING WET INTERIOR SURFACES OF HOLLOW CONTAINERS

BACKGROUND OF THE INVENTION

Many types of containers have interior surfaces which once wet are difficult to dry without causing undesired stains or spotting because towels or the like cannot be easily used. For example, when valued glassware such as champagne flutes or carafes have wet interior surfaces, even allowing such items exposed to ambient conditions until air dried does not avoid formation of spotting or haze.

The present invention permits such wet interior surfaces to be dried almost instantaneously so that the container is sparklingly dry without formation of stains, spotting or the like.

SUMMARY OF THE INVENTION

In accordance with the principles of this invention, the device for drying wet interior surfaces of a hollow container employs an elongated hollow flexible member which is both air and moisture permeable and is closed at both ends. One end of the member terminates in a long relatively thin extension. The member can be so constructed that the extension can be lengthened or shortened without changing the entire length of the member.

A plurality of small beads are employed. The beads are disposed moveably in the member. The beads have such physical and chemical properties that they collect and store moisture rapidly when the member is inserted through a container opening into said container and is moved into contact engagement with the wet surfaces. In this manner, the surfaces are dried rapidly and completely in a very short time period.

The member then can be removed from the container by pulling on the extension. Once the member is exposed to ambient conditions, the beads will dry by releasing the stored moisture to the ambient air.

BRIEF DESCRIPTION OF THE DRAWINGS

The accompanying drawing is a partially cut away perspective view of a preferred embodiment of the invention.

DETAILED DESCRIPTION OF PREFERRED EMBODIMENT

Referring now to the accompanying drawing, there is shown an elongated hollow member 10 formed of one hundred percent porous lint free tube of cotton sealed closed at one end 12 and sealed at the other end 14 by a long narrow extension 16 having a slip knot 18. By varying the position of the knot 18 by sliding it back and forth without tying or untying it, the extension can be lengthened or shortened to vary the volume of that portion of the member subtended between end 12 and the knot 18 without changing the overall length of the member.

Illustratively, the overall length can be twenty five inches and can have different diameters such as one inch, three eighths of an inch and five eighths of an inch.

The portion of the member subtended between end 12 and knot 18 is filled with individual beads 20 which are sized to pass through a mesh commercially identified as a 9×16 mesh form. These beads are molecular sieves which have the necessary characteristics both chemical and physical to rapidly collect and store moisture when brought into engagement with same and to rapidly release stored moisture and to dry completely when exposed to ambient air.

These beads are composed primarily of zeolite [about 75% to 85% by weight] but also contain about 15% to 23% by weight of manganese aluminosilicate and about 5% or less of quartz. Such beads are used in water filtration systems.

In use, the device is inserted into the container and is swirled against the wet surfaces until these surfaces are dry. The slip knot can be slid back and forth as previously explained to vary the bead filled length of the member and thus facilitate use with differently shaped containers.

The device should be stored in a zipper bag or any air-tight container when not in use.

While the invention has been described with particular reference to the drawings, the protection solicited is to be limited only by the terms of the claims which follow.

What is claimed is:

1. A device for drying wet interior surfaces of a hollow container having an opening for access, said device comprising:

an elongated hollow flexible moisture and air permeable tubular member of porous lint free cotton closed at both ends and terminating in a long relatively thin extension;

a plurality of small molecular sieve beads disposed moveably in said member, said beads collecting and storing moisture when the member is inserted through said opening into said container and is moved into contact with said surfaces, said beads releasing moisture into ambient air thereby drying the beads by pulling on said extension after the member is removed from the container and exposed to ambient conditions;

said extension including a slip knot which can be slid back and forth in order to lengthen or shorten the extension without changing the overall length of the member, said beads being confined to that portion of the member disposed between the knot and the opposite ends of the member.

2. The device of claim 1 wherein said sieves are composed primarily of zeolite.

3. The device of claim 2 wherein the individual beads are composed of about 75% to 85% zeolite, about 15% to 23% manganese aluminosilicate and about 5% or less of quartz.

4. The device of claim 3 wherein the beads are sized to pass through a mesh commercially identified as a 9×16 mesh form.

* * * * *